US008875956B2

(12) United States Patent
Haskayne et al.

(10) Patent No.: US 8,875,956 B2
(45) Date of Patent: Nov. 4, 2014

(54) CREAMY FOAM BEER DISPENSING SYSTEM

(71) Applicants: Paul Haskayne, Whitegate (GB); Robert Shettle, Huddersfield (GB); Donald Smeller, Converse, TX (US); Jarrell Jennings, III, Schertz, TX (US); Merrill Good, San Antonio, TX (US)

(72) Inventors: Paul Haskayne, Whitegate (GB); Robert Shettle, Huddersfield (GB); Donald Smeller, Converse, TX (US); Jarrell Jennings, III, Schertz, TX (US); Merrill Good, San Antonio, TX (US)

(73) Assignee: Lancer Corporation, San Antonio, TX (US)

( * ) Notice: Subject to any disclaimer, the term of this patent is extended or adjusted under 35 U.S.C. 154(b) by 0 days.

(21) Appl. No.: 14/170,956

(22) Filed: Feb. 3, 2014

(65) Prior Publication Data

US 2014/0138412 A1 May 22, 2014

Related U.S. Application Data

(62) Division of application No. 13/398,415, filed on Feb. 16, 2012, now Pat. No. 8,678,247.

(60) Provisional application No. 61/516,210, filed on Mar. 31, 2011.

(51) Int. Cl.

| | |
|---|---|
| ***B65D 83/00*** | (2006.01) |
| ***B67D 1/08*** | (2006.01) |
| ***B67D 1/14*** | (2006.01) |

(52) U.S. Cl.

CPC ..... *B67D 1/0841* (2013.01); *B67D 1/1411* (2013.01); *B67D 1/0835* (2013.01)

USPC ..... 222/400.7; 137/212; 137/322

(58) Field of Classification Search

USPC ..... 222/394, 399, 400.7; 137/212, 317, 137/320, 322

See application file for complete search history.

(56) References Cited

U.S. PATENT DOCUMENTS

| | | | | | |
|---|---|---|---|---|---|
| 569,801 | A | * | 10/1896 | Post | 222/400.7 |
| 713,113 | A | * | 11/1902 | Kraemer et al. | 222/400.7 |
| 729,145 | A | * | 5/1903 | Eckenwiler | 222/400.7 |
| 2,041,427 | A | * | 5/1936 | Meyer | 137/802 |
| 3,353,724 | A | * | 11/1967 | Johnston | 222/400.7 |
| 3,439,844 | A | * | 4/1969 | Johnston | 222/398 |
| 3,454,199 | A | * | 7/1969 | Malick | 222/400.7 |
| 3,464,435 | A | * | 9/1969 | Lamb et al. | 137/212 |
| 3,498,313 | A | * | 3/1970 | Belich | 137/322 |
| 3,596,810 | A | * | 8/1971 | Taubenheim | 222/400.7 |
| 4,125,209 | A | * | 11/1978 | Bailey | 222/400.7 |
| 4,159,102 | A | * | 6/1979 | Fallon et al. | 251/149.6 |
| 4,180,189 | A | * | 12/1979 | Zurit et al. | 222/400.7 |
| 4,181,143 | A | * | 1/1980 | Fallon | 137/322 |
| 4,291,821 | A | * | 9/1981 | Nezworski | 222/153.04 |
| 4,305,421 | A | * | 12/1981 | Fallon | 137/322 |

(Continued)

*Primary Examiner* — Patrick M Buechner

(74) *Attorney, Agent, or Firm* — Christopher L. Makay

(57) ABSTRACT

A creamy foam beer dispensing system includes a coupler removably securable with a keg, a transportation tube, and a faucet having a handle coupled with a plunger communicating with the transportation tube. The handle is movable among a closed position, an open position, and a creamy foam position. In the closed position, the handle maintains the plunger squeezed against the transportation tube such that no beer flows from the faucet. In the open position, the handle lifts the plunger substantially, completely off the transportation tube such that beer flows smoothly from the faucet. In the creamy foam position, the handle lifts the plunger off the transportation tube a distance such that an aperture created in the transportation tube produces creamy foam flow from the faucet.

3 Claims, 9 Drawing Sheets

(56) References Cited

U.S. PATENT DOCUMENTS

| | | | | | |
|---|---|---|---|---|---|
| 4,343,325 | A | * | 8/1982 | Fallon | 137/212 |
| 4,436,228 | A | * | 3/1984 | Frey | 222/400.7 |
| 4,538,746 | A | * | 9/1985 | Hines | 222/153.09 |
| 4,612,952 | A | * | 9/1986 | Fallon | 137/212 |
| 4,728,010 | A | * | 3/1988 | Johnston | 222/397 |
| 4,736,926 | A | * | 4/1988 | Fallon et al. | 251/149.9 |
| 4,834,266 | A | * | 5/1989 | Brewer et al. | 222/147 |
| 5,617,977 | A | * | 4/1997 | Augustinus | 222/400.7 |
| 5,636,657 | A | * | 6/1997 | Degenkolbe et al. | 137/212 |
| 5,690,136 | A | * | 11/1997 | Celli | 137/212 |
| 6,598,768 | B2 | * | 7/2003 | Celli | 222/400.7 |
| 2002/0050498 | A1 | * | 5/2002 | Celli | 222/400.7 |
| 2014/0124543 | A1 | * | 5/2014 | Dahl et al. | 222/400.7 |

* cited by examiner

CREAMY FOAM BEER DISPENSING SYSTEM

CROSS-REFERENCE TO RELATED APPLICATIONS

This application is a divisional of patent application Ser. No. 13/398,415, which was filed Feb. 16, 2012. This present application claims all available benefit, under 35 U.S.C. §119 (e), of U.S. provisional patent application Ser. No. 61/516,210 filed Mar. 31, 2011. By this reference, the full disclosure of U.S. provisional patent application Ser. No. 61/516,210 is incorporated herein as though now set forth in its entirety.

BACKGROUND OF THE INVENTION

1. Field of the Invention

The present invention relates to a beer dispensing system. More particularly, the beer dispensing system allows an operator to pour beer with or without creamy foam. In addition, the components of the beer dispensing system contacted by dispensed beer are disposable thereby removing the need for sanitation.

2. Description of the Related Art

In many parts of the world, consumers desire creamy foam on top of their beer. As such, beer dispensers that pour beer smoothly without foam followed by the ability to add creamy foam on top have been developed. These beer dispensers traditionally employ separate dispensing paths within a dispensing faucet. Opening of a first path delivers unfoamed beer, while opening of a second path delivers creamy foam. Although two path faucets operate adequately, they are complicated and costly to manufacture. Moreover, cleaning is labor intensive and, if not performed often or properly, leads to off-taste and unsanitary conditions in the beer dispensing system. Accordingly, a beer dispensing system employing a single dispensing path that is also disposable would improve over traditional beer dispensing systems.

SUMMARY OF THE INVENTION

In accordance with the present invention, a creamy foam beer dispensing system includes a coupler removably securable with a keg, a transportation tube, and a faucet. The transportation tube is disposable and includes a fitment engageable with the coupler, whereby beer flows from the keg through the transportation tube when the fitment is engaged with the coupler. The transportation tube further includes a line connected with the fitment and with a compression tube engageable with the faucet.

The faucet includes a compression tube receiver adapted to receive the compression tube therethrough such that the compression tube delivers beer from the faucet, a plunger communicating with the compression tube receiver, and a handle coupled with the plunger. The handle is movable among a closed position, an open position, and a creamy foam position. In the closed position, the handle maintains the plunger squeezed against the transportation tube such that no beer flows from the faucet. In the open position, the handle lifts the plunger substantially, completely off the transportation tube such that beer flows from the faucet. In the creamy foam position, the handle lifts the plunger off the transportation tube a distance such that an aperture created in the transportation tube produces creamy foam flow from the faucet.

The faucet further includes a first housing body defining the compression tube receiver and a plunger shaft communicating with the compression tube receiver and adapted to receive at least a portion of the plunger therein. The first housing body includes a stage therein adjacent to the compression tube receiver. The compression tube receiver includes a taper that contacts a stop on the compression tube to arrest the insertion of the compression tube into the compression tube receiver. The plunger includes a plunger head normally biased against the compression tube in the closed position whereby the plunger head squeezes the compression tube against the stage such that no beer flows from the faucet. The plunger head includes a groove such that, in the creamy foam position, the groove of the plunger head facilitates creation of the aperture that produces creamy foam flow from the faucet. The faucet further comprises a second housing body that supports the first housing body therein.

The handle is adjustable such that the distance the plunger lifts off the transportation tube is adjustable. The handle includes a lens, an insert adapted to receive a label, and a main body adapted to receive the insert therein. The main body further is adapted to receive the lens therein such that the lens retains the insert in the main body, wherein the lens and the insert are removable from the main body such that a new label may be received by the insert.

The coupler includes a body having a top end, a keg engagement end engageable with the keg, and a bore therethrough. The fitment of the transportation tube removably inserts through the top end and into the bore. The coupler further includes a lever pivotally connected with the body, wherein the lever is movable from a disengaged position to an engaged position that pushes the fitment downward within the bore such that the fitment opens a keg valve assembly thereby facilitating beer flow from the keg through the transportation tube. The body further includes a gas inlet communicating with the bore, wherein opening of the keg valve assembly by the fitment facilitates gas flow through the bore and into the keg. The coupler still further includes a spring pin that maintains the fitment within the bore.

The creamy foam beer dispensing system further includes a refrigeration module having a body adapted to receive a keg therein. The body includes a top with an opening, and a tower mounted onto the top of the body over the opening such that cool air from the body flows into the tower. The faucet mounts to the tower and includes a passage therethrough communicating with the tower such that cool air flows from the tower through the faucet thereby cooling the faucet.

The dispensing of a creamy foam beer into a suitable container is accomplished as follows. The handle is moved to its open position whereby the plunger lifts substantially, completely off the transportation tube such that beer flows from the faucet. The handle is maintained in its open position until beer exiting the faucet fills the container to a desired level. The handle is then released and moves to its closed position, thereby preventing beer flow from the faucet. Next, the handle is moved to its creamy foam position whereby the plunger lifts off the transportation tube a distance such that an aperture created in the transportation tube produces creamy foam flow from the faucet. The handle is maintained in its creamy foam position until creamy foam exiting the faucet fills the container to a desired level. Finally, the handle is again released and moves to its closed position, thereby preventing beer flow from the faucet.

Replacing a used transportation tube with a new transportation tube is accomplished as follows. First, the coupler lever is moved from its engaged position to its disengaged position such that the fitment of the transportation tube releases the keg valve assembly thereby preventing beer flow from the keg through the transportation tube. Second, the fitment is removed from the top end of the coupler and the transportation tube is removed from the faucet. Third, the transportation tube is removed from a tower of the beer dispensing system and the removed transportation tube is disposed. Fourth, a new transportation tube is inserted into the tower of the beer dispensing system. Fifth, a beer dispensing end of the new transportation tube is inserted into the faucet, and a fitment of the new transportation tube is inserted through the top end of the coupler and into the bore of the coupler. Finally, the coupler lever is moved from its disengaged position to its engaged position, whereby the lever pushes the fitment downward within the bore such that the fitment opens the keg valve assembly thereby facilitating beer flow from the keg through the transportation tube.

DETAILED DESCRIPTION OF THE PREFERRED EMBODIMENT

Figure 1:
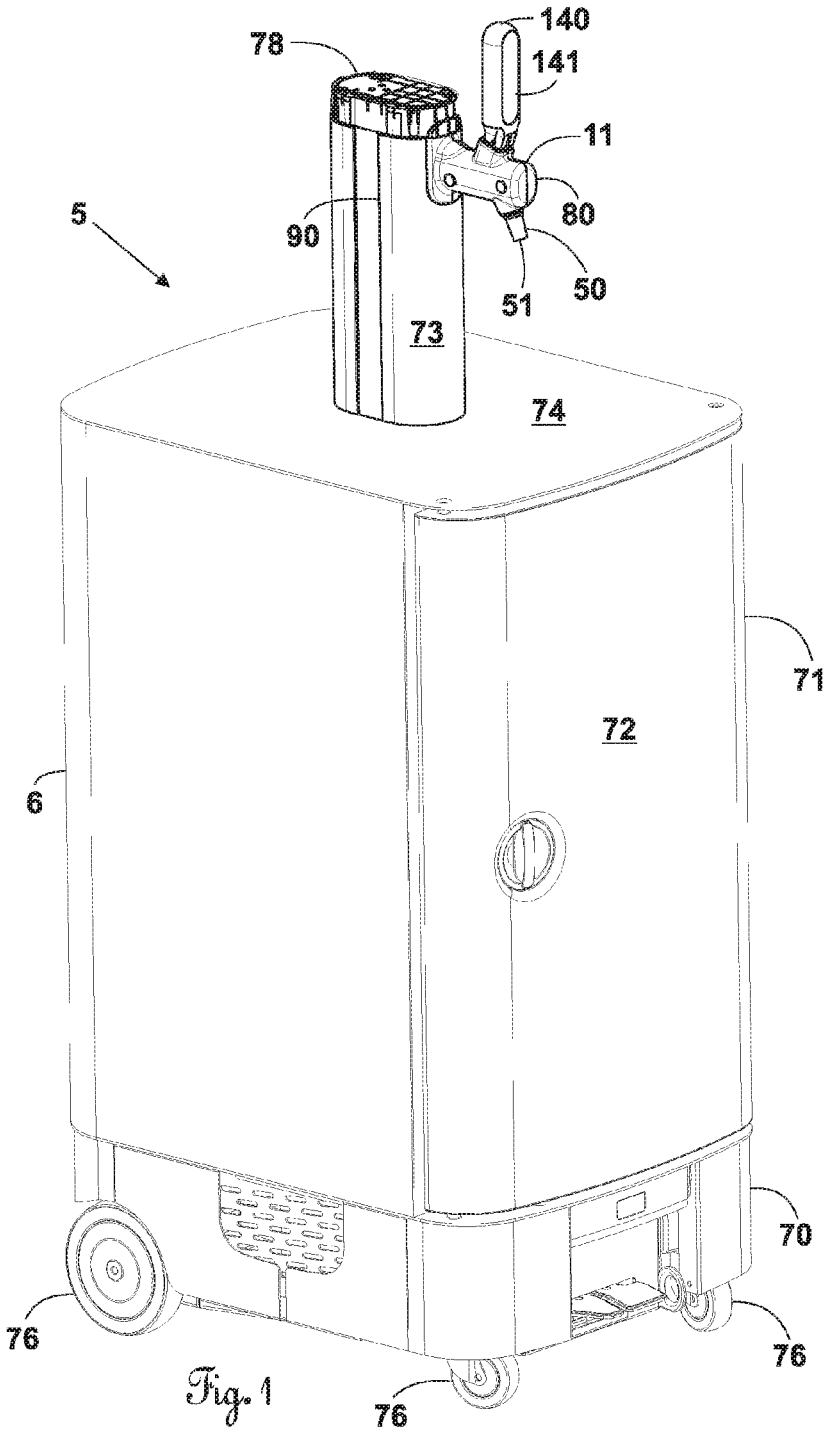
FIG. 1 is a perspective view illustrating a creamy foam beer dispensing system according to the preferred embodiment.

As required, detailed embodiments of the present invention are disclosed herein; however, it is to be understood that the disclosed embodiments are merely exemplary of the invention, which may be embodied in various forms. Figures are not necessarily to scale, and some features may be exaggerated to show details of particular components or steps.

The Figures illustrate a creamy foam beer dispensing system 5 according to the preferred embodiment of the present invention. The creamy foam beer dispensing system 5 delivers beer from a keg 7 and includes a refrigeration module 6, a transportation tube 9, a coupler 8, and a faucet 11.

FIG. 1 illustrates the refrigeration module 6. The refrigeration module 6 includes a base 70, a body 71, a door 72, and a tower 73. The base 70 has wheels 76 that allow the refrigeration module 6 to be easily moved. The body 71 mounts on the base 70 while the door 72 attaches to the body 71. The body 71 and the door 72 define a chamber that receives the keg 7 therein. The body 71 includes a top 74 with an opening communicating with the chamber. The tower 73 mounts on the top 74 over the opening such that cool air within the chamber travels to the tower thereby cooling the tower 73. The tower 73 provides the attachment point for the faucet 11 and includes a body 90 with an opening for the faucet 11 and a top 78. While the faucet 11 has been shown as attached to the tower 73, those of ordinary skill in the art will recognize that the faucet 11 may be located at any suitable dispensing point and then connected with the refrigeration module 6 through a hose.

The production of creamy foam typically requires beer to be kept at a specific temperature, 34 degrees Fahrenheit in the preferred embodiment. As such, the refrigeration module 6 includes a refrigeration unit that maintains the keg 7 housed therein at the desired specific temperature.

Figure 2:
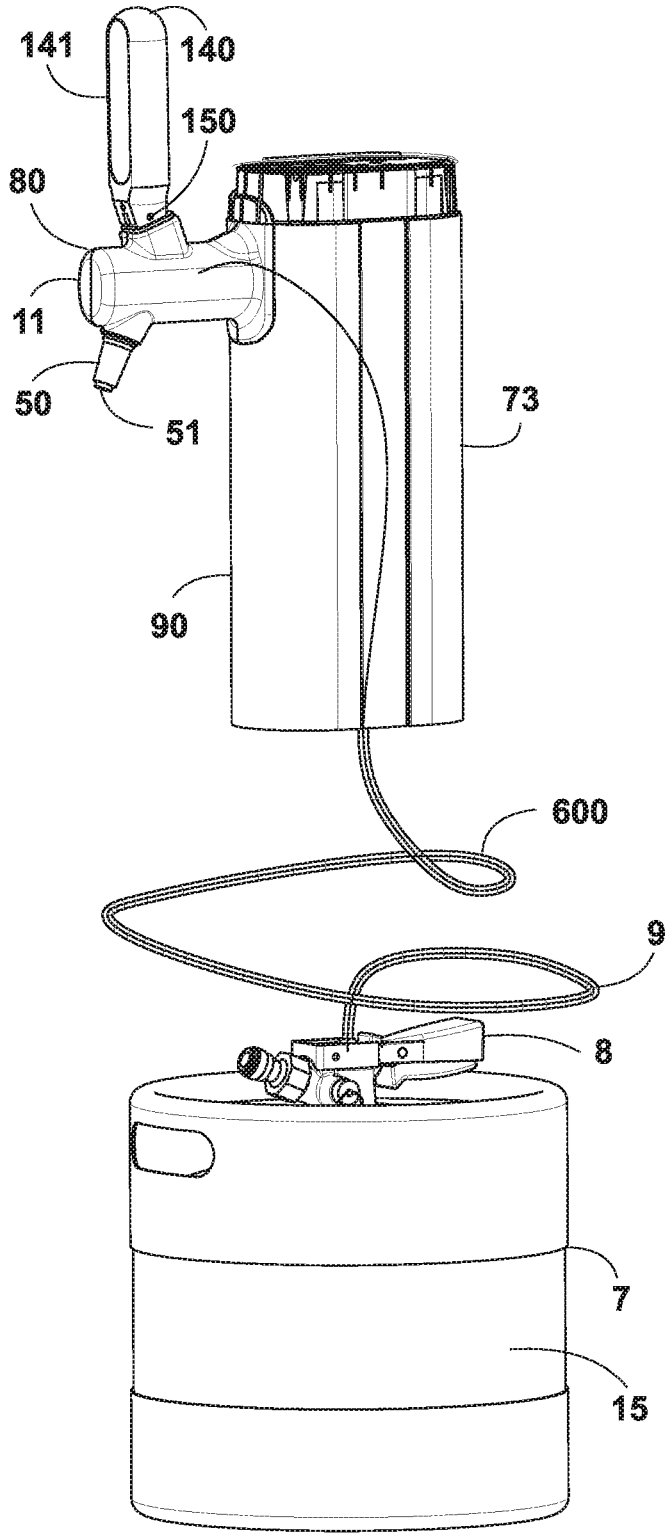
FIG. 2 is a perspective view illustrating a coupler, a tower, and a faucet of the creamy foam beer dispensing system.
Figure 3:
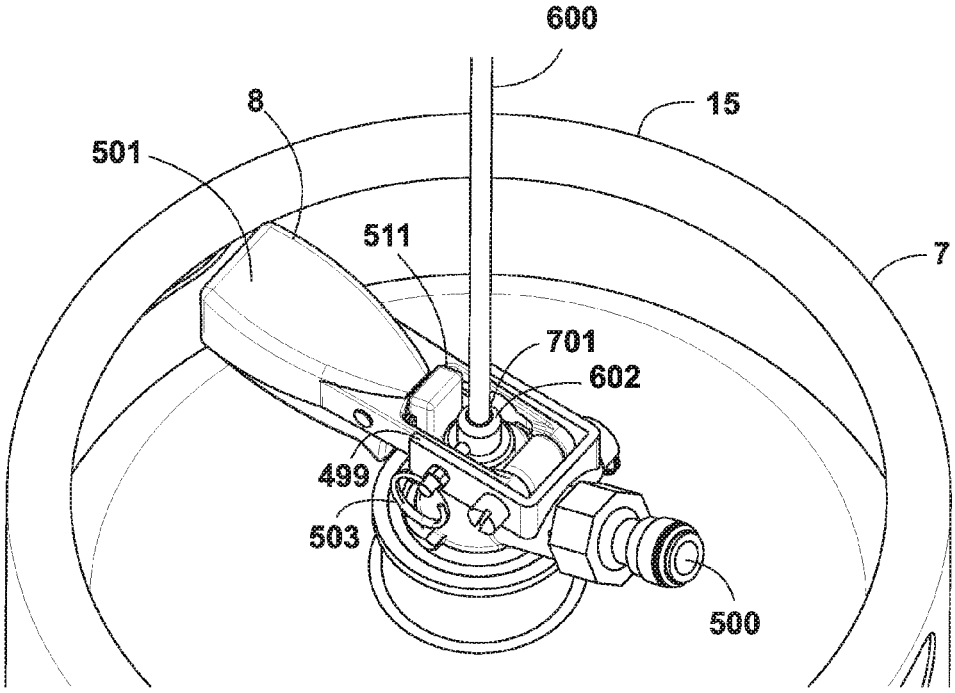
FIG. 3 is a perspective view illustrating the coupler of the creamy foam beer dispensing system.
Figure 4:
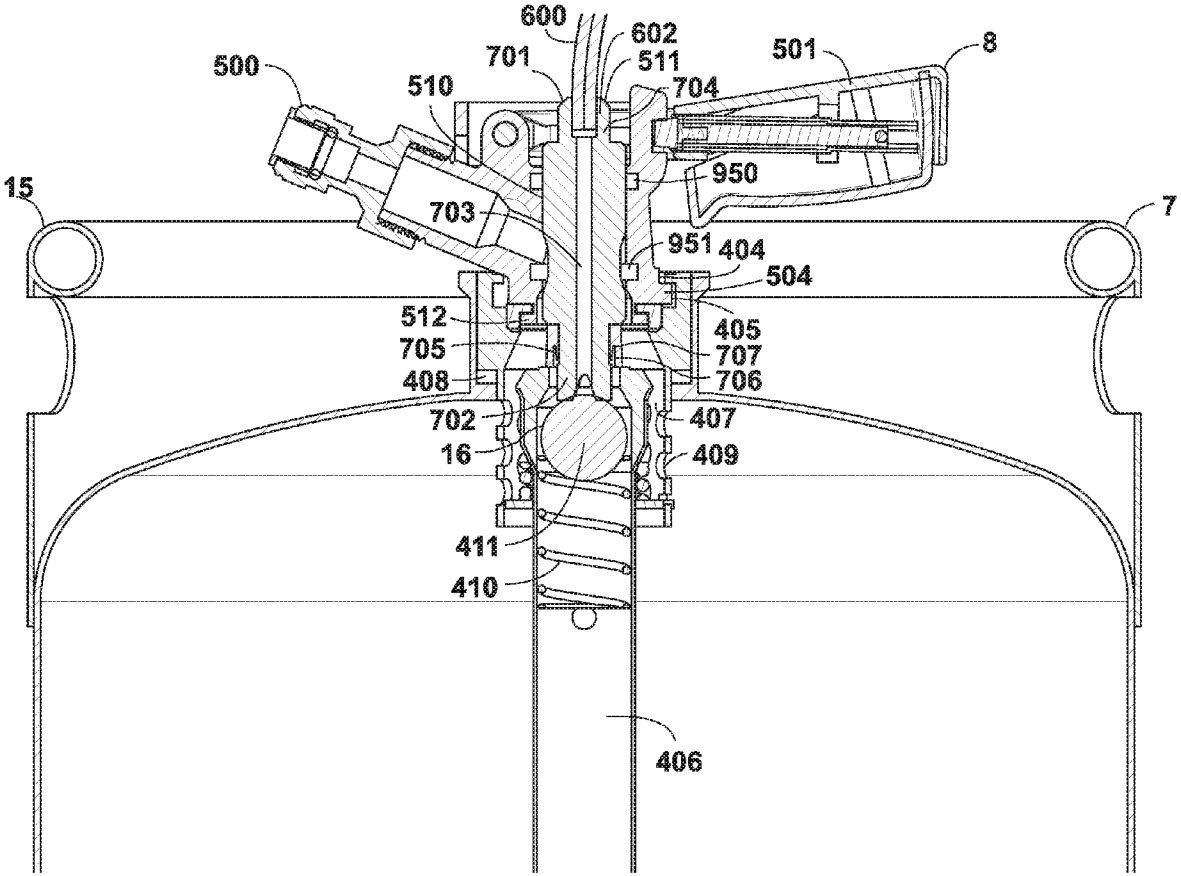
FIG. 4 is a cross-sectional view illustrating the coupler of the creamy foam beer dispensing system.
Figure 5:
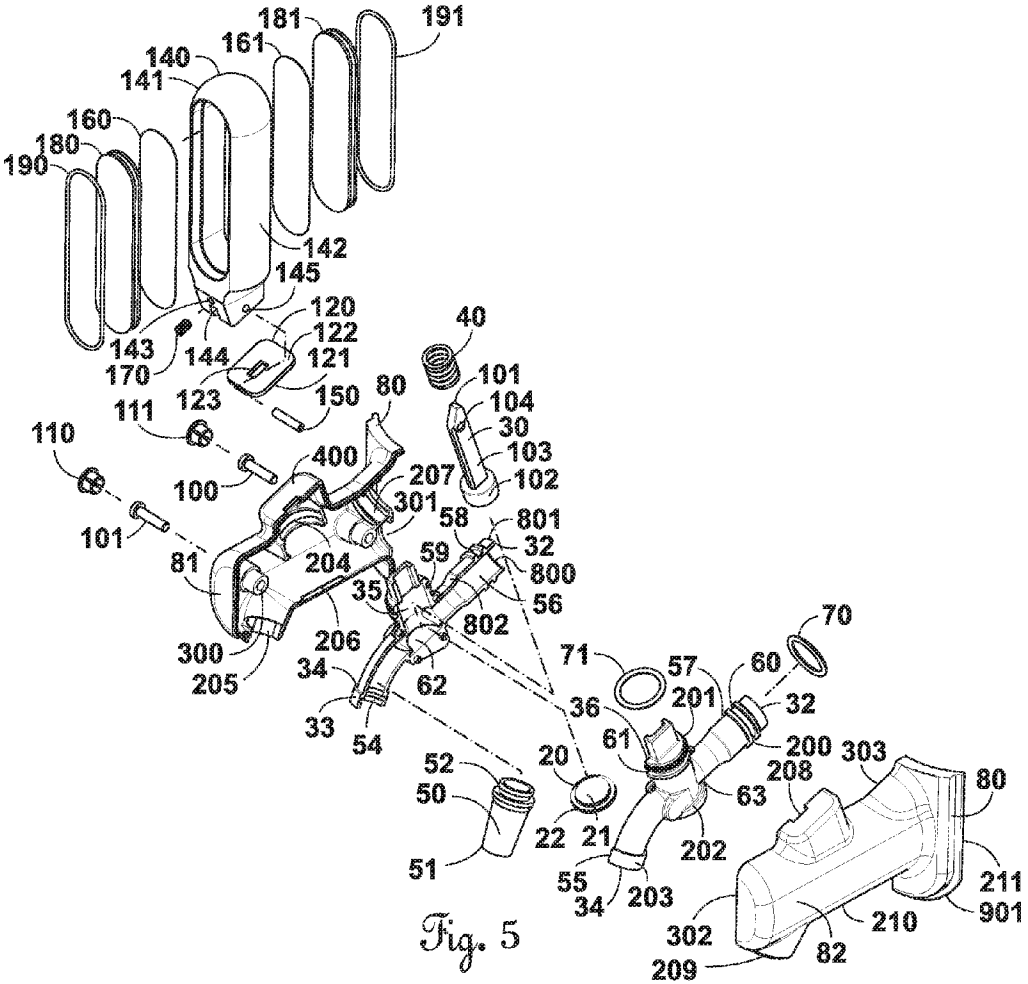
FIG. 5 is an exploded perspective view illustrating the faucet of the creamy foam beer dispensing system.

FIGS. 2, 3, and 4 illustrate the keg 7 which is a standard keg well known to those of ordinary skill in the art. The keg 7 includes a shell 15 having an opening 407, a self-closing valve assembly 16 disposed in the opening 407, and a spear 406 connected with the self-closing valve assembly 16 and extending into the shell. The shell 15 of the keg 7 can be made of any material, but typical keg shells are constructed from stainless steel or aluminum. The self-closing valve assembly 16 allows pressurized gas to flow into the keg 7 and beer to flow out through the spear 406. The self-closing valve assembly 16 includes a body 408 mounted within the opening 407 of the shell. The body 408 includes a slot 404 and a ramp 405 that function as the securing point for the coupler 8. The body 408 includes apertures 409 that communicate gas into the shell 15. The self-closing valve assembly 16 further includes a spring-loaded valve 410 disposed in the body 408 for maintaining the body 408 normally closed. The self-closing valve assembly 16 still further includes a ball valve 411 disposed in the spear 406 for maintaining the spear 406 normally closed.

FIGS. 2, 3, 4, 6, 7, and 8 illustrate the transportation tube 9. The transportation tube 9 is disposable, and is the only component of the creamy foam beer dispensing system 5 that contacts the beer. As such, the transportation tube 9 may be discarded after the keg 7 has been emptied, and replaced when a new keg 7 is tapped. This disposability eliminates the cleaning normally associated with non-disposable systems, thereby reducing labor for the end user. While the transportation tube 9 may be discarded after each keg, it should be understood that the transportation tube 9 may be employed with multiple kegs provided the kegs are used during a limited time period, such as within the same day.

The transportation tube 9 includes a line 600, a compression tube 601, and a fitment 602. The fitment 602 includes a first end 701 securable with the transportation tube 9, a second end 702 configured to engage the ball valve 411 of the keg 7, and a beer passage 703 therethrough. The fitment 602 includes a groove 705 that receives a seal 706 that is configured to engage the spring-loaded valve 410 of the keg 7. The seal 706 includes a groove 707 that allows the seal 706 to expand over the spring-loaded valve 410 when contacted by beer. The fitment 602 resides in the coupler 8 and includes a shoulder 704 that provides the coupler 8 with an engagement point. Once the coupler 8 has been secured to the keg 7, the fitment 602 engages the self-closing valve assembly 16 of the keg 7 to allow gas flow into the keg 7 and beer flow from the spear 406 into the line 600. In the preferred embodiment, the fitment is formed from any suitable material such as plastic.

The line 600 of the transportation tube 9 attaches at a first end to the first end 701 of the fitment 602 and at a second end to the compression tube 601. The connection of the line 600 to the fitment 602 and the compression tube 601 may be accomplished through a press fit, an adhesive, a molding process, or any other suitable attachment method. The line 600 may be plastic or any suitable material formed in a diameter and length that optimizes the flow rate of beer from the fitment 602 to the compression tube 601. In particular, the length and diameter of the line 600 relates to a pressure drop in the beer flow that produces a smooth pour. If the line 600 is too short, the pressure drop is insufficient resulting in a turbulent pour and foaming. Alternatively, if the line 600 is too long, the pressure drop is excessive resulting in an undesirable flow rate. Consequently, the length and diameter of the line 600 is selected in a range that produces an optimal pressure drop a beer flow rate. In the preferred embodiment, the line 600 is 66 inches in length.

The compression tube 601 includes a first end 710 that receives the second end of the line 600 therein and a second end 711 that delivers beer from the compression tube 601. The first end 710 of the compression tube 601 includes a stop 712 that aids in positioning the compression tube 601 within the faucet 11. In particular, the compression tube 601 inserts into the faucet 11 until the stop 712 contacts the faucet 11 and arrests the forward motion of the compression tube 601. Once positioned in the faucet 11, the second end 711 of the compression tube 601 extends from the faucet 11 to deliver beer from the faucet 11. The compression tube 601 may be rubber or any similar elastic material that conforms to the curved shape of the faucet 11, thereby providing a smooth flow.

In the preferred embodiment, the line 600 and the compression tube 601 essentially provide a smooth hose that furnishes a smooth flow path for the beer delivered from the keg 7. As such, the line 600 and the compression tube 601 are free from the expansions, contractions, and turns that normally produce carbonation break-out.

FIGS. 3 and 4 illustrate the coupler 8. The coupler 8 includes a body 499 having a top end 511, a keg engagement end 512, a spring pin 503, a tab 504, and a gas inlet 500. The body 499 includes a bore 510 therethrough and grooves 950 and 951 that receive o-rings therein. The coupler 8 further includes a lever 501 pivotally connected with the body 499 such that the lever is movable from a disengaged position to an engaged position. In the engaged position, a biased locking member of the lever 501 engages the body 499 to secure the lever 501 with the body 499. The coupler 8 is attached to the keg 7 in the following manner. The tab 504 is lined up with the slot 404 of the keg 7 and inserted through the slot 404 until the tab 504 aligns with the ramp 405. The coupler 8 is then rotated such that the tab 504 travels along the ramp 405, thereby securing the coupler 8 to the keg 7.

The body 499 includes the bore 510 for receipt therein of the transportation tube fitment 602. The fitment 602 inserts into the coupler 8 through the top end 511 of the body 499 until the fitment resides substantially, completely within the bore 510. Prior to insertion of the fitment 602, the spring pin 503 is pulled back to allow the fitment 602 unrestricted access into the bore 510. After insertion of the fitment 602, the spring pin 503 is released thereby securing the fitment 602 within the bore 510. The ability of the coupler 8 to receive the fitment 602 from the top improves over other couplers. Conventional couplers receive fitments from underneath. In addition, the fitments must be threadably secured to the couplers. The coupler 8 accordingly eliminates the labor-intensive features of prior couplers because the fitment 602 is insertable into the coupler 8 from the top and without tools.

While affixing the coupler 8 to the keg 7 via the tab 504 secures the coupler 8 with the keg 7, it does not open the self-closing valve assembly 16 of the keg 7. The opening of the self-closing valve assembly 16 requires the movement of the lever 501 from its disengaged position to its engaged position. As the lever 501 moves to its engaged position, the lever 501 engages the shoulder 704 of the fitment 602 and pushes the fitment 602 downward within the bore 510 such that the fitment 602 opens the self-closing valve assembly 16. In particular, the seal 706 engages the spring-loaded valve 410 and depresses the spring-loaded valve 410 downward away from the body 408, thereby creating an entrance into the keg for gas. Similarly, the second end 702 engages the ball valve 411 and depresses the ball valve 411 downward into the spear 406, thereby creating a flow path from the keg 7 into the beer passage 703 of the fitment 602. Once the lever 501 locks in its engaged position, the fitment 602 maintains the self-closing valve assembly 16 open.

With the self-closing valve assembly 16 open, gas, carbon dioxide gas in the preferred embodiment, flows through the gas inlet 500 into the bore 510 between the bore 510 and the fitment 602. The gas flows between an o-ring in the groove 951 and the fitment 602 and into the body 408 of the self-closing valve assembly 16. The gas flows from the body 408 and into the keg 7 via the apertures 409 in the body 408. The gas pressurizes the beer and further serves as the driving force for the delivery of beer from the keg 7 into the beer passage 703 via the spear 406. When the lever 501 moves from its engaged position to its disengaged position, the spring-loaded valve 410 returns to its closed position against the body 408, and the ball valve 411 returns to its closed position at the top of the spear 406. This pushes the fitment 602 upward within the bore 510 until the fitment engages the o-ring within the groove 951, thereby preventing any escape of gas or beer from the coupler 8.

FIGS. 1, 2, 5, 6, 7, and 8 illustrate the faucet 11. The faucet 11 includes an inner or first housing body 32, an outer or second housing body 80, and a handle 140. FIGS. 5, 6, 7, and 8 illustrate the components of the inner or first housing body 32. The inner or first housing body 32 includes an inner or first left housing 33, an inner or first right housing 34, a spout 50, a plunger 30, a stage 20, o-rings 70 and 71, and a spring 40. The inner or first left housing 33 has a plunger shaft 35, a spout groove 54, a tube shaft 56, a stage groove 62 and o-ring grooves 58 and 59. The inner or first right housing 34 has a plunger shaft 36, a spout groove 55, a tube shaft 57, a stage groove 63 and o-ring grooves 60 and 61. The tube shaft 56 and the tube shaft 57 come together to form a compression tube receiver 800. The compression tube receiver 800 has a first end 801 that is the entry point for the compression tube 601. The compression tube receiver 800 also includes a taper 802 that engages the stop 712 of the compression tube 601 and aids in final positioning of the compression tube 601. The spout 50 is conically shaped and has a nozzle end 51 and a tube end 52. After final assembly, the spout 50 will face down and allow a uniform pour of beer.

Figure 9:
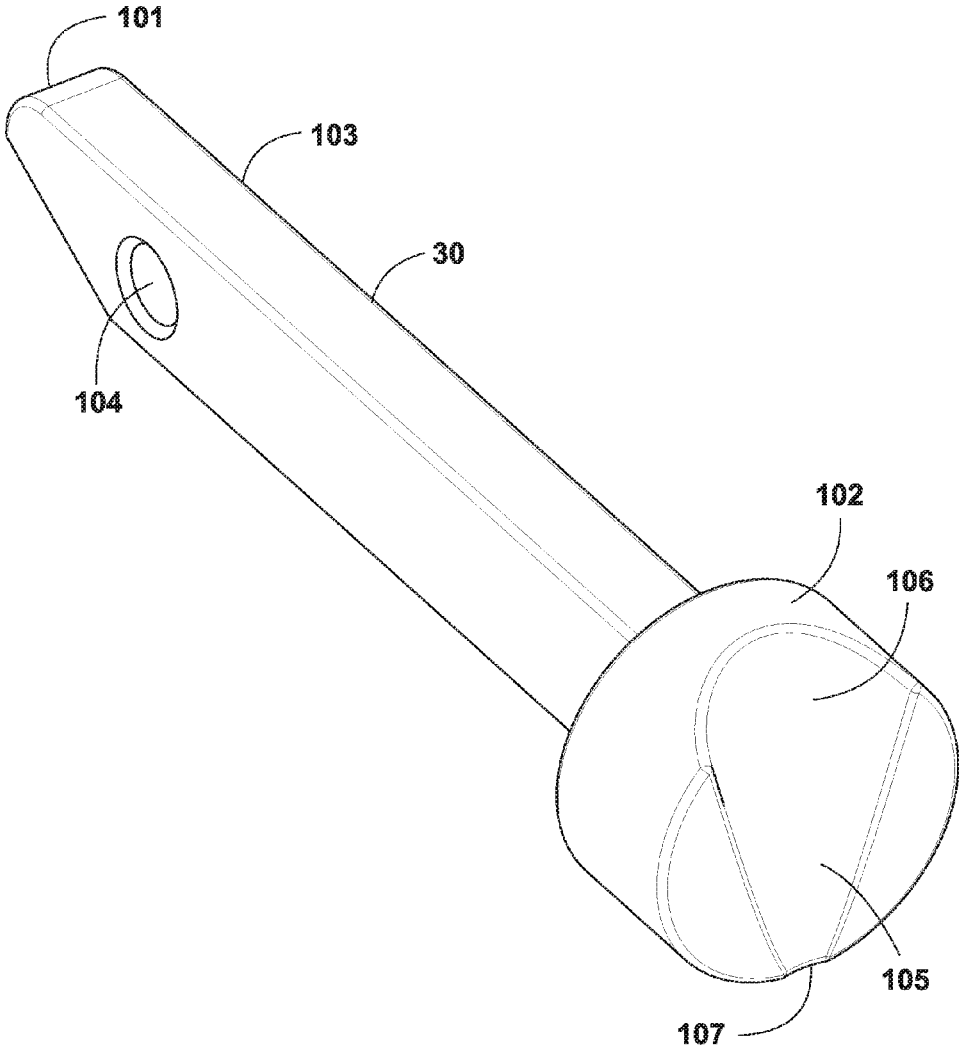
FIG. 9 is a perspective view illustrating a plunger for the faucet of the creamy foam beer dispensing system.

As illustrated in FIG. 9, the plunger 30 has a top end 101, a plunger head 102, a stem 103, and an inner roll pin hole 104. The plunger head 102 has a groove 105, which is conical in the preferred embodiment. While the groove 105 is conical in the preferred embodiment, those of ordinary skill in the art will recognize other shapes for the groove 105. The groove 105 has a tube entrance 106 and a spout exit 107. The stage 20 has a top surface 21 and a bottom surface 22. Both the plunger 30 and the stage 20 engage the compression tube 601 to create the desired beer flow.

Assembly of the inner or first housing body 32 is as follows. The stage 20 is placed into the stage groove 62 of the inner or first left housing 33 and the stage groove 63 of the inner or first right housing 34. The tube end 52 of the spout 50 is placed into the spout groove 54 of the inner or first left housing 33 and the spout groove 55 of the inner or first right housing 34. The spring 40 is placed over the stem 103. The plunger 30 and the spring 40 are placed within the plunger shaft 35 of the inner or first left housing 33 and the plunger shaft 36 of the inner or first right housing 34. The plunger 30 is oriented so that the plunger head 102 is facing the top surface 21 of the stage 20. The tube entrance 106 of the groove 105 is oriented away from the spout 50. The spout exit 107 of the groove 105 is oriented towards the spout 50. For final assembly the inner or first left housing 33 and the inner or first right housing 34 are then snapped together. The o-rings 70 and 71 are then placed over the o-ring grooves 58-61 of the inner or first left housing 33 and the inner or first right housing 34. Placing the o-rings 70 and 71 over the o-ring grooves 58-61 locks the inner or first left housing 33 and the inner or first right housing 34 together into one piece thereby forming the inner or first housing body 32. When assembled the inner or first housing body 32 will have slots 200-204. The inner or first housing body 32 will be placed inside the outer or second housing body 80.

The outer or second housing body 80 includes an outer or second left housing 81, an outer or second right housing 82, screws 100-101, an outer body shim mating surface 400, and plugs 110-111. The outer or second left housing 81 has grooves 204-207, screw channels 300-301, and a passage 900. The outer or second right housing 82 has grooves 208-211, screw channels 302 and 303, and a passage 901. The outer or second housing body 80 is assembled in the following manner. The inner or first housing body 32 is placed inside the outer or second left housing 81. This is accomplished by lining up the slots 200-204 of the inner or first housing body 32 with the grooves 204-207 of the outer or second left housing 81. The grooves 208-211 of the outer or second right housing 82 are lined up with slots 200-204 of the inner or first housing body 32. The screw channels 302 and 303 of the outer or second right housing 82 are lined up with the screw channels 300-301 of the outer or second left housing 83. The outer or second right housing 82 and the outer or second left housing 83 are then snapped together. The screws 100-101 are inserted into the screw channels 300-303 of the outer or second left housing 81 and the outer or second right housing 82. The plugs 110 and 111 are then placed inside the screw channels 300 and 301. Once the outer or second left housing 81 and the outer or second right housing 82 have been fitted together, the passage 900 and the passage 901 align to form an outlet 902 from outer or second housing body 80. It should be understood that the outer or second housing body 80 provides the enclosure that supports the inner or first housing body 32 and the nozzle 50. The shape of the outer or second housing body 80 accordingly is not critical to the dispensing of beer from the faucet 11. As such, those of ordinary skill in the art will recognize that the outer or second housing body 80 may have any aesthetically pleasing shape that provides support for the inner or first housing body 32 and the nozzle 50.

The handle 140 includes a main body 141, labels 160-161, inserts 180-181, lens 190-191, a set screw 170, a shim 120, and a roll pin 150. The main body 141 has a main gripping surface 142, a set screw hole 143, a plunger channel 144, and an outer roll pin hole 145. The shim 120 includes an outer body mating surface 121, a handle mating surface 122, and a plunger hole 123.

The handle 140 is assembled in the following manner. The labels 160 and 161 are placed into the inserts 180 and 181. The inserts 180 and 181 are then placed into the main body 141 of the handle 140. The lenses 190 and 191 are placed over the inserts 180 and 181 and snapped into the main body 141. The stem 103 of the plunger 30 is placed through the plunger hole 123 of the shim 120. The outer body mating surface 121 of the shim 120 is placed on top of the outer body shim mating surface 400. The top end 101 of the plunger 30 is placed into the plunger channel 144 of the handle 140. The outer roll pin hole 145 of the handle 140 is lined up with the inner roll pin hole 104 of the plunger 30. The roll pin 150 is fed through the outer roll pin hole 145 and the inner roll pin hole 104. The set screw 170 is threaded into the set screw hole 143 to provide an adjustment in the distance the handle 140 may be rotated aft.

The handle 140 provides several useful functions. The handle 140 is the control point for the operator of the creamy foam beer dispensing system 5. The handle also allows labels 160 and 161 to be placed inside the main body 141 of the handle 140. The placing of the labels 160 and 161 allows an operator to advertise the beer for sale as well as provide a visual indication of the beer at the faucet 11.

After assembly the faucet 11 is attached to the body 90 of the tower 73 over the opening in the body 90 using any suitable means such as a friction fit, screws, or the like. In the preferred embodiment, the top 78 separates from the body 90, which remains secured to the top 74 of the body 71, in order to permit easy access to the faucet 11. The compression tube 601 enters the faucet 11 via the opening in the body 90 of the tower 73. It should be understood that the handle 140 of the faucet 11 must be placed forward in a full open position in order for the compression tube 601 to be inserted into the faucet 11. The compression tube 601 then feeds into the first end 801 of the compression tube receiver 800 of the faucet 11. The compression tube 601 is pushed towards the spout 50 until the stop 712 engages the taper 802 halting progress of the compression tube 601 through the compression tube receiver 800. The compression tube 601 is held firmly in place by friction with the surface of the compression tube receiver 800. The compression tube 601 will be straight where the plunger 30 and the stage 20 meet and curved as it feeds through the spout 50. After the compression tube 601 is fed into the faucet 11, the line 600 and the fitment 602 are fed through the body 90 of the tower 73 and ultimately enter the chamber of the refrigeration module 6 via the opening in the top of the body 71. In that position, the fitment 602 is ready for placement in the coupler 8. The top 78 of the tower 73 is replaced, and the creamy foam beer dispensing system 5 thus is ready to dispense beer.

The refrigeration unit of the refrigeration module 6 not only provides cooling for the keg 7 but also operates to cool the faucet 11. Cool air from the chamber of the refrigeration module 6 travels into the tower 73 through the opening in the top 74 of the body 71. The cool air travels from the tower 73 into the faucet 11 via the opening in the tower 73. Once the cool air enters the faucet 11, it flows through the faucet 11 and out therefrom via the outlet 902, thereby providing a continuous flow of cool air through the faucet 11.

Figure 6:
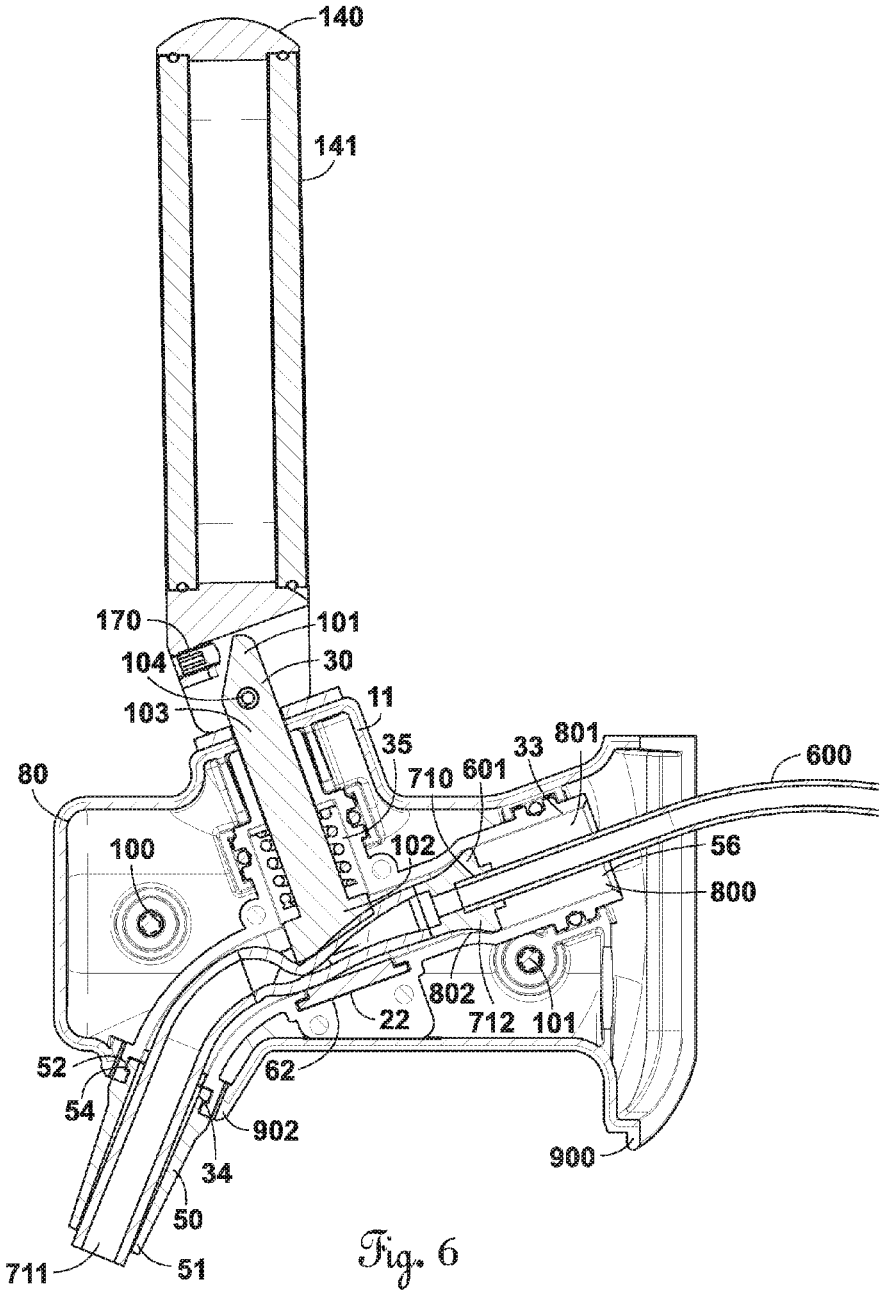
FIG. 6 is a cross-sectional view illustrating the faucet of the creamy foam beer dispensing system in its closed position.

FIGS. 6, 7, 8 and 9 illustrate the operation of the creamy foam beer dispensing system 5. The handle 140 of the faucet 11 controls the delivery of beer from the creamy foam beer dispensing system 5 through three operating positions—off or closed, forward or open, and aft or creamy foam. The handle 140 is spring-loaded such that, when the handle 140 is manipulated either forward or aft, it acts upon the plunger 30 resulting in the delivery of beer. However, once pressure on the handle 140 is released, the spring 40 returns the plunger 30 and the handle 140 to the off or closed position as illustrated in FIG. 6. When the handle 140 is in the off or closed position, the spring 40 maintains the plunger 30 squeezed against the compression tube 601 with sufficient force to seal the compression tube 601 shut. In particular, the plunger 30 and the stage 20 create a pinch valve that prevents beer flow through the compression tube 601.

Figure 7:
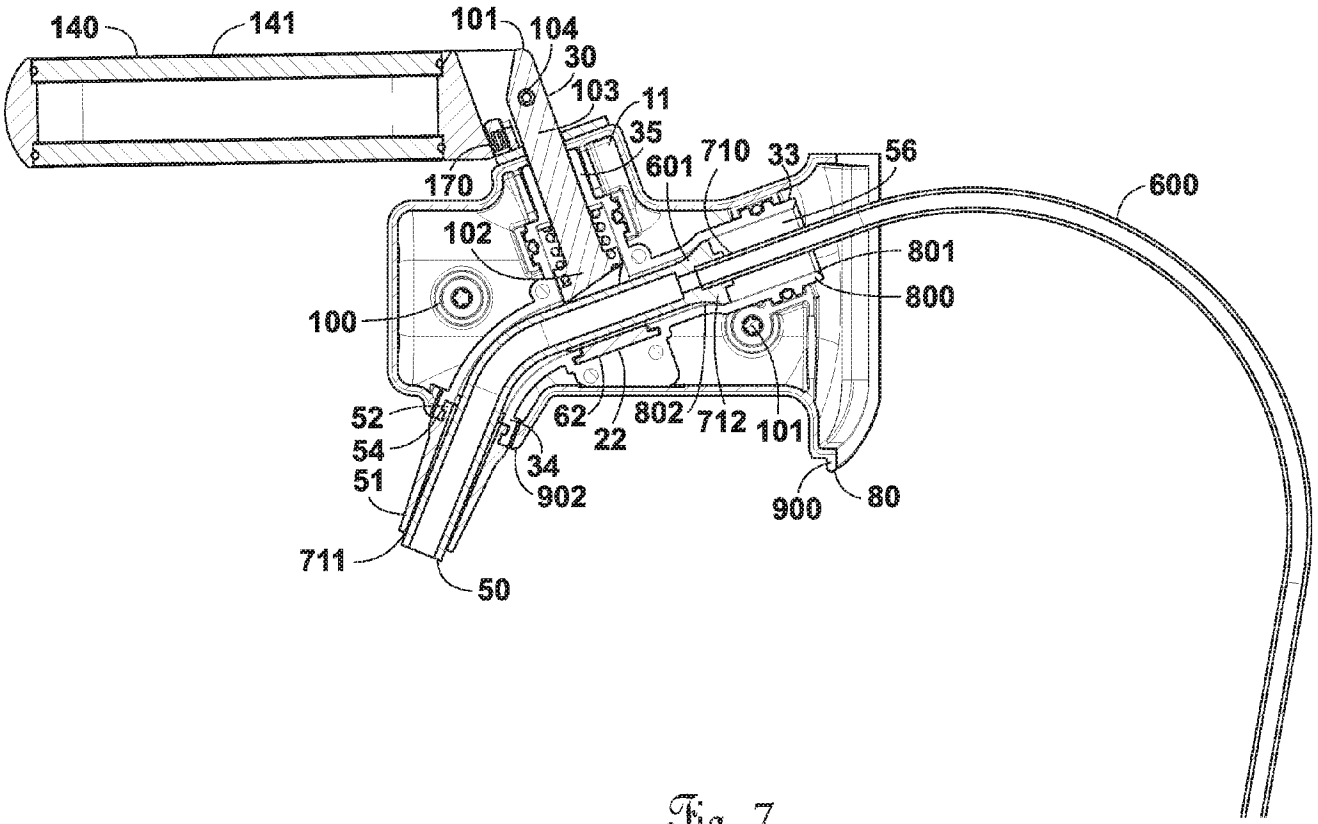
FIG. 7 is a cross-sectional view illustrating the faucet of the creamy foam beer dispensing system in its fully open position.

FIG. 7 illustrates the forward or open position of faucet 11. When the handle 140 is rotated forward, the handle 140 pivots around the roll pin 150 and towards the operator. This action raises the plunger 30 completely off the compression tube 601, thereby releasing the pressure on the compression tube 601. As a result, the compression tube 601 expands to its full diameter. With the compression tube at its full diameter and with no restriction to the flow, beer pours uniformly and without foam from the spout 50 and into a suitable container. In particular, beer flows from the keg 7 into the spear 406, from the spear 406 into the fitment 602, from the fitment 602 into the line 600, from the line 600 into the compression tube 601, and from the compression tube 601 into a suitable container. Return of the handle 140 to the off or closed position stops the flow of beer from the faucet 11.

Figure 8:
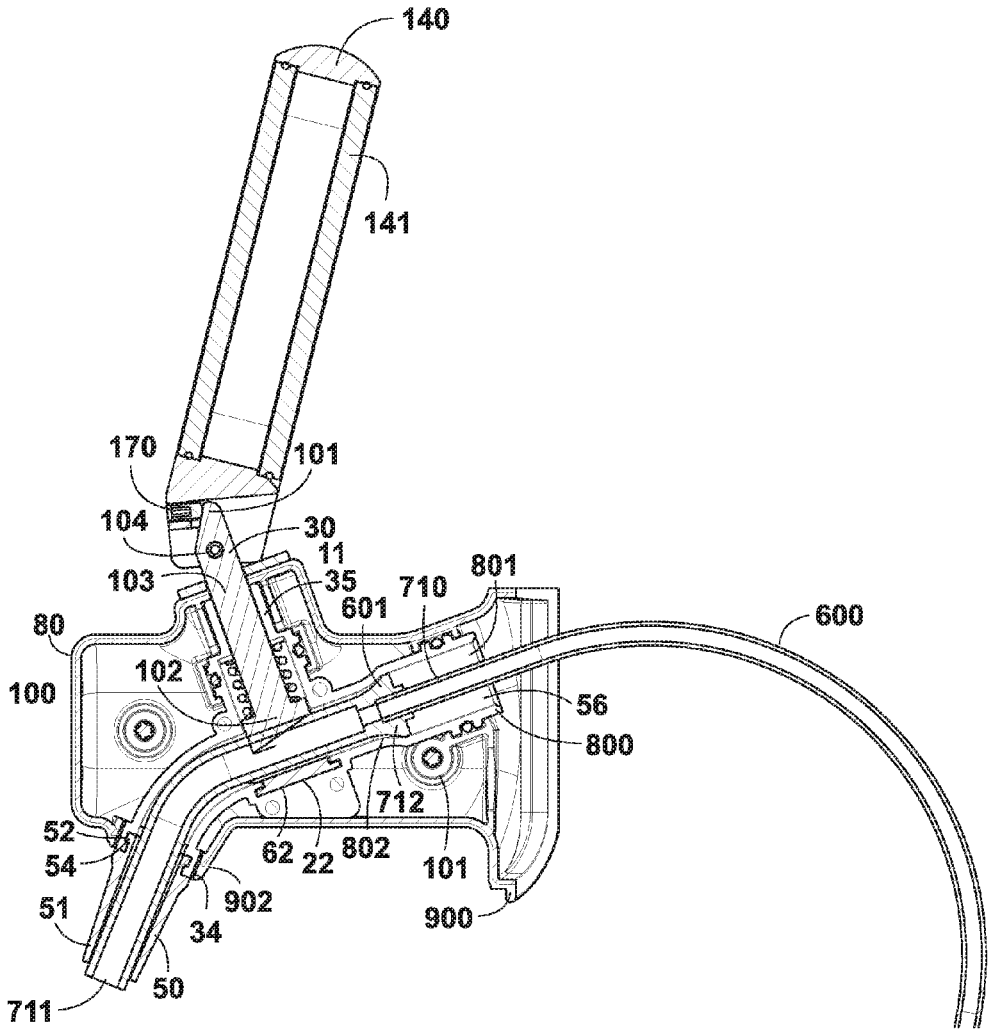
FIG. 8 is a cross-sectional view illustrating the faucet of the creamy foam beer dispensing system in its creamy foam beer position.

FIG. 8 illustrates the aft or creamy foam position of the faucet 11. When the handle 140 is rotated aft, the handle 140 pivots around the roll pin 150 and away from the operator. This action raises the plunger 30 slightly off the compression tube 601. Specifically, as the plunger 30 is raised slightly, the pinch point created on the compression tube 601 by the plunger head 102 is released such that the compression tube 601 opens at the spout exit 107 thereby creating a small diameter aperture. This allows beer to flow through the compression tube 601 following a path within the compression tube 601 defined by the tube entrance 106, the groove 105, and the spout exit 107. As the beer moves towards the spout exit 107, the small diameter aperture restricts the beer flow prior to the delivery of the beer from the small diameter aperture into the full diameter of the compression tube 601. By traversing from the small diameter aperture into the full diameter of the compression tube 601, the gas within the beer is allowed to expand rapidly, thereby forming creamy foam upon exit from the spout 50. Return of the handle 140 to the off or closed position stops the flow of creamy foam from the faucet 11.

The size of the small diameter aperture created through the slight raising of the plunger 30 determines the density of the foam, which may vary from light to heavy. In particular, density of the foam decreases as the diameter of the small aperture increases. Since different operators may desire different densities of the creamy foam, the faucet 11 includes the set screw 170 within the handle 140. Adjustment of the set screw 170 changes the distance the handle 140 may be rotated aft and therefore how far the plunger 30 rises off the compression tube 601.

The creamy foam beer dispensing system 5 improves over conventional dispensing systems because it provides a disposable transportation tube 9 in combination with a faucet 11 that pours both a smooth flow beer and a creamy foam from a single line. Furthermore, the use of a disposable transportation tube 9 including a fitment 602 that loads from the top into a coupler 8 eliminates labor intensive cleaning.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description; rather, it is defined only by the claims that follow.

The invention claimed is:

1. A coupler for a beer dispensing system, comprising:

a body, comprising:

a top end, a keg engagement end engageable with a keg, and a bore therethrough, wherein a fitment of a transportation tube removably inserts through the top end and into the bore; and a lever pivotally connected with the body and movable from a disengaged position to an engaged position, wherein pivoting the lever to its engaged position moves the lever into contact with a fitment when the fitment is disposed in the bore and pushes the fitment downward within the bore such that the fitment opens a keg valve assembly thereby facilitating beer flow from the keg through the transportation tube, further wherein pivoting the lever to its disengaged position moves the lever out of contact with a fitment when the fitment is disposed in the bore thereby releasing the fitment to move upward within the bore and away from a keg valve assembly such that the keg valve assembly closes to stop beer flow from the keg through the transportation tube, still further wherein pivoting the lever to its disengaged position moves the lever away from the bore to permit unrestricted access thereto thereby allowing insertion of a fitment into the bore through the top end when no fitment resides in the bore and removal of a fitment from the bore through the top end when the fitment resides in the bore.

2. The coupler for a beer dispensing system according to claim 1, wherein the coupler further comprises a spring pin coupled with the body and extending therethrough, further wherein the spring pin is movable from a first position whereby the spring pin extends into the bore to restrict access thereto thereby maintaining the fitment within bore to a second position whereby the spring pin retracts from the bore to permit unrestricted access thereto thereby allowing insertion of the fitment into and removal of the fitment from the bore through the top end.

3. The coupler for a beer dispensing system according to claim 1, wherein the body further comprises a gas inlet communicating with the bore, wherein opening of the keg valve assembly by the fitment facilitates gas flow through the bore and into the keg.

* * * * *